United States Patent [19]

Roeder

[11] 4,369,022

[45] Jan. 18, 1983

[54] VALVE ASSEMBLY FOR HYDRAULICALLY ACTUATED DOWNHOLE PUMPS

[76] Inventor: George K. Roeder, P.O. Box 4335, Odessa, Tex. 79760

[21] Appl. No.: 175,468

[22] Filed: Aug. 5, 1980

[51] Int. Cl.[3] ..... F04B 21/06; F04B 39/10

[52] U.S. Cl. ..... 417/571; 137/516.11

[58] Field of Search ..... 417/564, 559, 570, 571; 137/516.11

[56] References Cited

U.S. PATENT DOCUMENTS

| | | | |
|---|---|---|---|
| 2,622,942 | 12/1952 | Munoz | 417/559 |
| 2,908,287 | 10/1959 | Augustin | 137/856 |
| 3,277,830 | 10/1966 | Kalest, Jr. et al. | 417/571 X |
| 4,032,266 | 6/1977 | Roeder | 417/571 |

FOREIGN PATENT DOCUMENTS

| | | | |
|---|---|---|---|
| 323389 | 12/1934 | Italy | 137/516.11 |

*Primary Examiner*—William L. Freeh
*Attorney, Agent, or Firm*—Marcus L. Bates

[57] ABSTRACT

A check valve assembly for use as intake and discharge valves for pumps. The assembly includes a valve element made into a square configuration, the corners of which are slidably received in indexed relationship within radially spaced, longitudinally extending grooves formed into opposed, interior, peripheral wall surfaces of the pump housing and made complementary respective to the marginal area represented by the corners of the valve element. This configuration of the valve components prevents axial rotation of the valve element, and forms four radially spaced crescent shaped inlet and outlet passageways between each of the valve elements and the pump housing. An intake cage is axially spaced in opposed relationship respective to an exhaust cage by a valve plate, with the intake cage, exhaust cage, valve plate, intake and exhaust valve elements being concentrically arranged respective to one another. The entire check valve assembly is located at one end of a pump barrel, so that reciprocal movement of a pump piston reciprocatingly received within the barrel produces fluid through the check valve assembly.

7 Claims, 9 Drawing Figures

VALVE ASSEMBLY FOR HYDRAULICALLY ACTUATED DOWNHOLE PUMPS

BACKGROUND OF THE INVENTION

Hydraulically actuated pumping apparatus used downhole in a borehole for producing a wellbore generally includes a hydraulically actuated engine which reciprocates a piston associated with a downhole pump, so that production fluid is forced into the pump working chamber and then upwards towards the surface of the earth along with spent power fluid from the engine. Hydraulically actuated, downhole pumps are very complex in design and are usually made for operation in deep, slim boreholes.

In my previously issued U.S. Pat. Nos. 4,032,266 and 2,932,312, there is disclosed a check valve system for pumps which constitute an improvement over the Coberly U.S. Pat. No. 2,081,222. Reference is made to these previously issued patents for further background of this invention. In several of these previously issued patents, there is disclosed a valve structure in the form of a circular hub member, or valve plate, which has a plurality of exhaust and intake ports formed therein. The intake ports are formed therein by two intersecting constant diameter counterbores, with one of the counterbores being vertically disposed and located circumferentially spaced from the axial bore which receives the connecting rod therethrough, and with the other connecting counterbores being normally arranged and radially disposed respective to the first recited counterbores. The exhaust ports are located between the intake ports and extend parallel to the longitudinal axial centerline of the pump assembly. Opposed valve elements are biased into engagement with the exhaust ports located on one side of the valve plate and into engagement with the intake ports located on the other side of the valve plate. This configuration of a check valve assembly results in a cylindrical valve structure having coacting parts, some of which can axially rotate respective to the valve plate.

Further, in these and other prior art valve assemblies, provision must be made for the flow of formation fluid into the intake ports of the valve plate and the flow of produced fluid through the exhaust ports of the valve plate. Usually the fluid is conducted about an exhaust cage and then laterally into the inlet passageways of the valve plate. The passageways must be made as large as possible to enhance pump efficiency and to reduce fluid velocity, thereby avoiding damage to the valve plate interior by errosion resulting from debris admixed with the fluid. However, the fluid, as it flows to and from the valve plate ports, is forced to flow about a small annular area formed between the valve element and the intake or exhaust cage, so regardless of the improvements in pressure drop occasioned by the design of the valve plate, there remains a significant loss in efficiency because of the geometry of the valve elements and cages.

It is, therefore, desirable to provide a downhole, hydraulically actuated pump of a reciprocating type with improvements in the valve assembly associated therewith, which exhibits increased structural integrity along with improved flow characteristics, so that the life of the entire system is significantly prolonged, and overall pump efficiency is enhanced.

SUMMARY OF THE INVENTION

An improved check valve device for use in the production end of a hydraulically actuated, downhole pump assembly. The valve device includes a novel valve element made into a polygon, which preferably is of a square configuration. There are two valve elements, each arranged on opposed sides of a valve plate. The plate has an upper and lower face, an axial bore for sealingly receiving the pump piston rod therethrough in a reciprocating manner, a plurality of radially spaced-apart longitudinal passageways extending through the hub in alternate relationship respective to a plurality of radially spaced-apart ports which extend axially only partially through the hub, and then turn normal to and away from the axial bore. The pump housing includes opposed cages, the inner wall of which has four longitudinally extending grooves made complementary respective to the corners of the valve element, so that the corners of the valve element are slidably received within the grooves, thereby preventing axial rotation of the valve element respective to the valve plate.

An outwardly directed annulus is formed about an outer sidewall surface of the plate member and includes radially spaced segments of a cylinder connected to each of the blind ports so that fluid flows from the annulus, through the segmented cylindrical port, up through the blind port, and into the working chamber of the production pump; while produced fluid from the working chamber flows back through the longitudinal passageway of the valve plate, across the opposed valve element, and then out of the pump assembly.

Hence, the valve elements provide opposed spring-loaded valve closure members which sealingly engage a seat formed on each opposed face of the valve plate to thereby form a check valve assembly so that fluid can be pumped from the borehole annulus, through the valve plate and intake cage, into the working chamber, back through the valve plate and exhaust cage, where the production fluid is exhausted from the pump end as the pump piston is reciprocated by the engine piston.

The polygon configuration of the valve element cooperates with the longitudinal grooves and cage sidewall to form cresent shaped flow passageways between each adjacent corner of the valve element, which provides for low pressure drop across the valve element as fluid flows to and from the working chamber of the pump. Hence, there are radially spaced, cresent shaped flow passageways provided within each valve element cage, and since fluid flowing to and from the working chamber must flow in series relationship across one valve element one time and across another valve element two times during its forced travel through the pump assembly, it follows that the formation fluid is pumped through three series of groups of radially spaced, crescent shaped flow passageways.

The relationship of the valve seats respective to the valve plate and element can be reversed, if desired, since the valve element remains indexed at all times with respect to the valve plate. This is considered a sub-combination of the invention.

Accordingly, a primary object of the present invention is the provision of a valve device having improved structural integrity imparted thereinto as a result of the novel configuration of the valve elements associated therewith.

Another object of the invention is to provide improvements in the flow characteristics of fluids flowing through a check valve device associated with a reciprocating pump.

A further object of this invention is to disclose and provide an improved valve device for a reciprocating pump which controls the flow of fluid into and out of a pump mechanism in response to reciprocation of a pump piston associated therewith.

A still further object of this invention is the provision of an improved cage, valve element, and valve plate for a valve assembly associated with a reciprocating pump.

Another and still further object of this invention is the provision of a ported valve plate having a valve element made into a configuration which captures the element adjacent to the end of the port in a non-rotatable and indexed manner, while at the same time the flow characteristics of the fluid flowing through the assembly is improved.

An additional object of the invention is to provide a valve device having a plate and element made into a geometrical configuration which non-rotatably captures the element in low friction relationship for longitudinal movement within the valve device, while promoting the resistance to abrasive action of fluids flowing through the body.

Still another object of this invention is the provision of a check valve assembly having a valve element which is urged against a valve plate to control fluid flow to and from a pump working chamber, and wherein the configuration of the check valve assembly is such that pumped fluid flows in series relationship through three groups of crescent shaped passageways formed within the check valve assembly.

These and other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described in the above abstract and summary.

DETAILED DESCRIPTION OF THE PREFERRED EMBODIMENT

Figure 1:
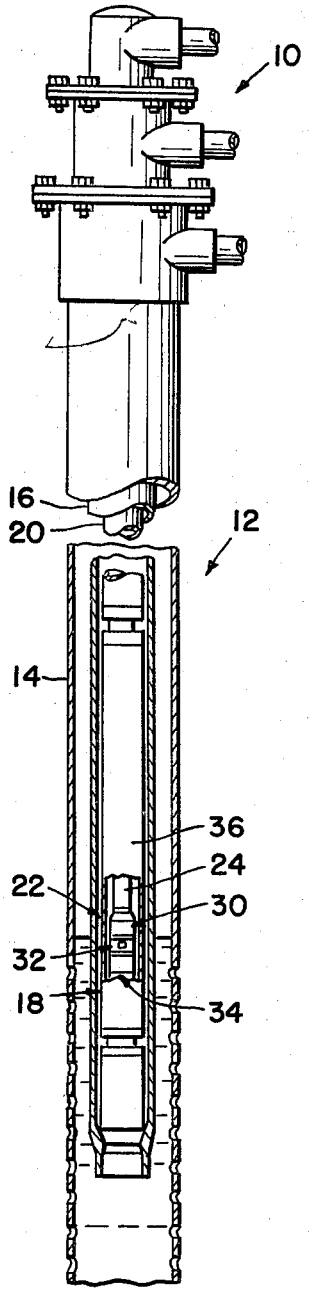
FIG. 1 is a broken, part diagrammatical, part schematical, part cross-sectional, longitudinal view of a wellbore having a downhole hydraulically actuated pump assembly associated therewith.

In FIG. 1, there is illustrated a wellhead 10 connected to a borehole 12 which extends down into the earth and is usually provided with a casing 14. The well includes a production tubing 16 within which there is disposed a downhole, hydraulically actuated pump assembly 18. Power oil tubing 20 extends from the wellhead down to the engine associated with the pump to provide power oil thereto in the usual manner. Numeral 22 broadly indicates the valve assembly of the present invention, which is associated with the production end of the pump assembly.

Figure 2:
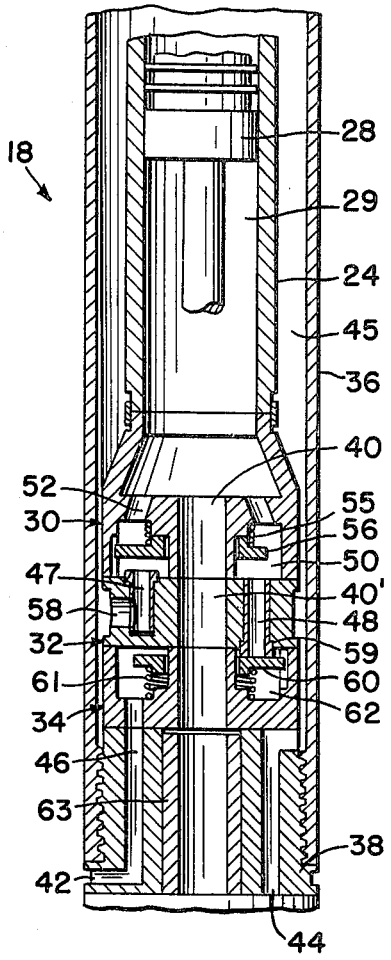
FIG. 2 is a diagrammatical, part cross-sectional, enlarged view of the check valve apparatus of the present invention seen broadly disclosed in FIG. 1.
Figure 5:
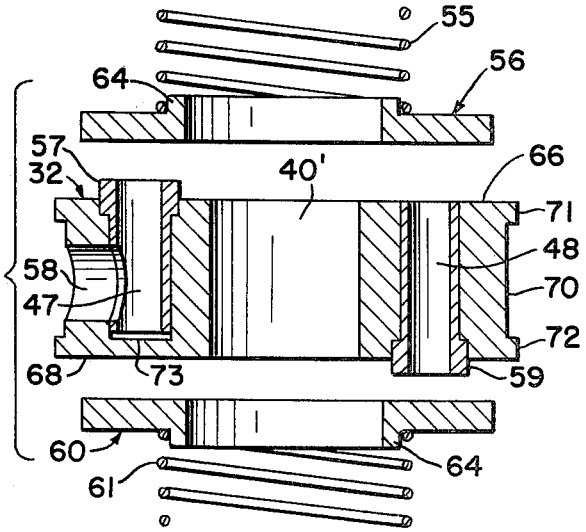
FIG. 5 is still a further enlarged, part cross-sectional, exploded view of part of the apparatus disclosed in the foregoing figures.

As seen in FIG. 2, the production end of the downhole pump assembly includes a pump barrel 24, which can take on several different forms, and which includes a connecting rod connected to a pump piston 28 of conventional design which reciprocates within a working chamber 29.

The pump barrel is connected to the sub assembly 22 which includes the check valve assembly of the present invention. An intake cage 30, a valve plate 32, and an exhaust cage 34 are components of the sub assembly. The sub assembly includes an outer cylindrical pump housing 36 which threadedly engages a lower sub 38 so that the entire apparatus can be conveniently disassembled. Axial bore 40 longitudinally extends through the longitudinal axial centerline of the valve assembly at 40' in close tolerance relationship with respect to a rod which is reciprocatingly received axially therethrough in a sealed manner.

Produced fluid outlet 42 is flow connected to the production tubing annulus, while formation fluid inlet 44 is connected to the formation fluid inlet of the pump and to the pump annulus 45, thereby providing the suction side of the pump valve assembly with a source of formation fluid. The exhaust cage 34 includes an outlet 46 which is flow connected to the before mentioned outlet port 42.

Figure 3:
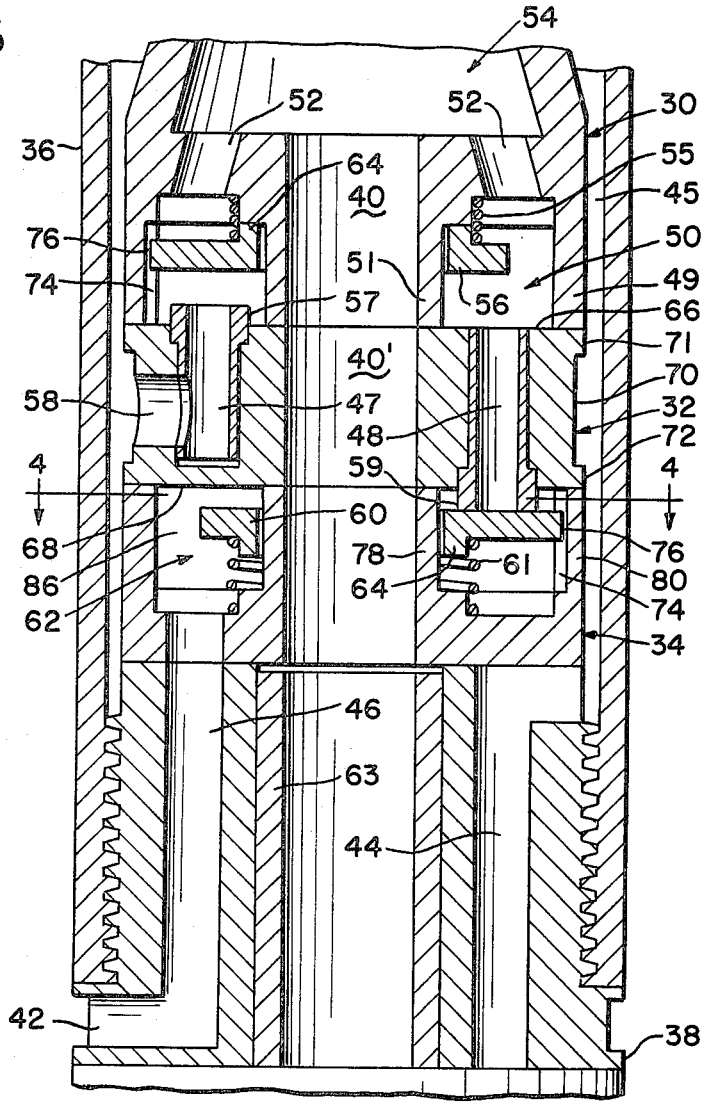
FIG. 3 is an enlarged, fragmentary, part cross-sectional, isolated view of part of the apparatus seen disclosed in FIG. 1, and may be taken along line 3—3 of FIG. 4, wherein lines 3—3 are 135° to one another.
Figure 4:
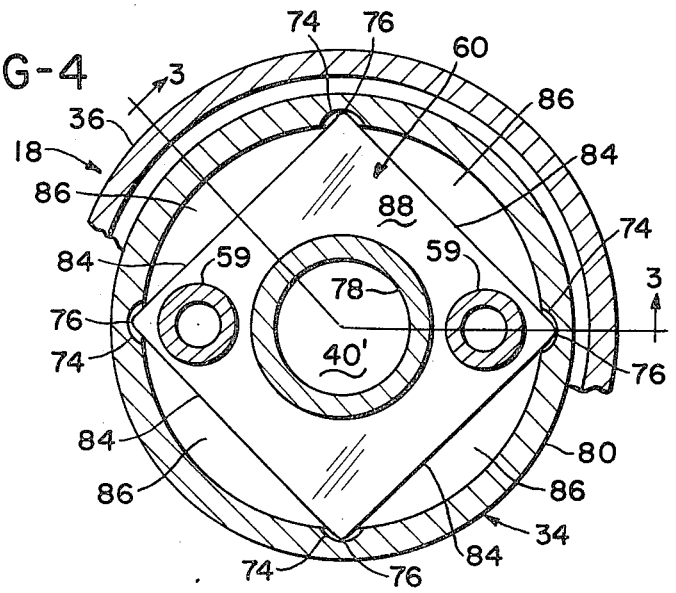
FIG. 4 is a cross-sectional view taken along line 4—4 of FIG. 3.

As seen disclosed in various figures of the drawings, and in particular, FIGS. 3 and 4, the valve plate of the present invention is provided with a plurality of radially spaced apart flow passageways 47 and 48 which are circumferentially arranged along a common circle respective to one another, and radially arranged respective to the central or axial bore 40', so that fluid can flow through inlet ports 58, into the interior 50 of the intake cage, and from the intake cage through the exhaust passageways 48.

Outer and inner skirt members 49 and 51 form the intake chamber 50 within the intake cage. Flow passageway 52 connects chamber 50 of the upper housing with the lower extremity 54 of the working chamber of the production pump. Biasing means, in the form of a coil spring 55, biases a valve element 56 into seated engagement respective to a plurality of upstanding valve seats 57, hereinafter referred to as "standoff valve seats". A plurality of outwardly directed, radially spaced-apart ports 58 are in fluid communication with annulus 45.

A standoff valve seat 59 forms the lower end portion of the longitudinal passageways 48 and sealingly receives the opposed valve element 60 thereagainst in proportion to the force exerted by a biasing spring means 61, which is in the form of a coil spring located within cavity 62 which forms the exhaust chamber within the lower housing, also referred to herein as a "lower valve spring cage", or "lower cage". Cylindrical bushing 63 sealingly engages a marginal length of the reciprocating piston rod in a slideable manner.

As best seen illustrated in FIGS. 2–5, in conjunction with other figures of the drawings, the valve elements 56 and 60 are provided with a centrally located annular lip 64 which captures one end of spring 55 or 61 such that the lower face of the element 56 or upper face of element 60 sealingly engages the outer face of the standoff seats in aligned relationship therewith to provide a fluid-tight seal therebetween. The opposed end of each spring is captured by the illustrated boss formed on the respective cage.

As seen illustrated in FIGS. 5–8, the valve assembly of the present invention includes the before mentioned valve plate which is in the form of a circular hub, and which is provided with an upper face 66 spaced in opposed relationship from a lower face 68, with the faces preferably being parallel to one another. A circumferentially extending annulus 70 is formed about a midportion of the plate or hub member by undercutting the midportion thereof to form a reduced diameter, outwardly opening, annular area 70 which is curved back into the body to form the outer peripheral wall surface of the member at 71 and 72. Each of the inlet ports comprise vertical counterbores 73 which are of constant diameter, and which communicate with longitudinal passageway 47 as illustrated. The outer marginal end of the passageway receives the standoff valve element 57 by press fitting the boss of the element within the enlarged diameter portion formed at the marginal upper end portion thereof.

As seen in FIG. 3, the exhaust cage includes an inner skirt 78 and outer skirt 80, which forms the before mentioned exhaust cavity, with the exhaust valve element 60 being reciprocatingly received within the exhaust cavity.

Figure 8:
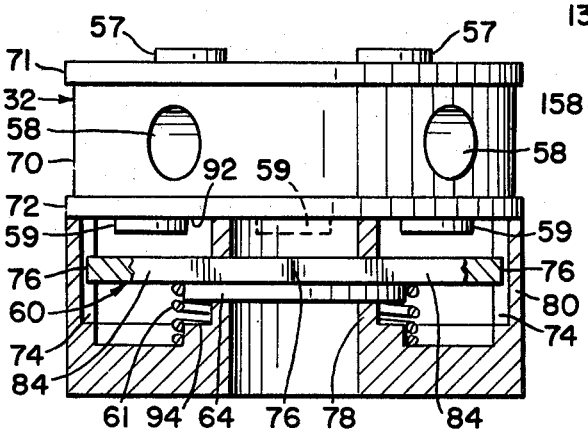
FIG. 8 is a cross-sectional view taken along line 8—8 of FIG. 6; and, FIG. 9 sets forth a modification of part of the apparatus of FIG. 8.

As best seen in FIGS. 2, 3, and 8, each of the opposed outer skirts 49 and 80 include four radially spaced vertical grooves 74 longitudinally disposed in equally spaced apart relationship on the interior surface thereof for slidably receiving a marginal end of a valve element corner 76 in captured relationship therewithin.

Figure 6:
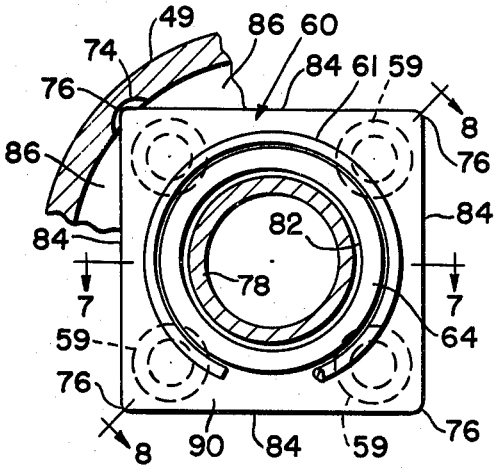
FIG. 6 is a fragmented, part cross-sectional, top plan view of part of the apparatus disclosed in FIGS. 1–5.
Figure 7:
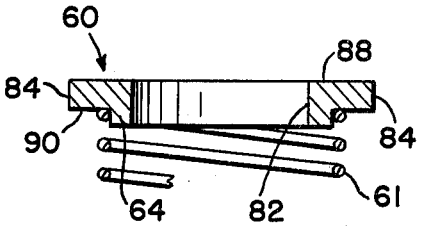
FIG. 7 is a cross-sectional view taken along line 7—7 of FIG. 6.

In FIGS. 6 and 7, it is seen that the illustrated valve element includes an inside diameter 82, and sidewalls 84 which meet at corners 76. These are crescent shaped passageways formed by the intervening area between edges 76 of the apparatus; that is, the sidewalls 84, and the inner wall of the outer skirt form radially spaced crescent shaped flow passageways 86 through which fluid flow to and from the pump can be conducted. Hence, the valve element includes upper and lower faces 88 and 90, wherein the face 88 sealingly engages seat 59. As noted in FIG. 8, the grooves 74 extend between the limits 92 and 94, the former also being the face of the valve plate, for example.

Figure 9:
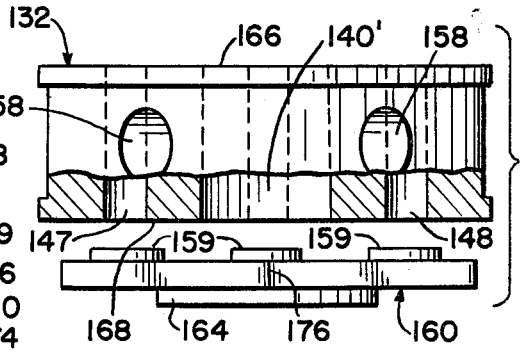

In the alternate embodiment of the invention set forth in FIG. 9, assuming that the apparatus is operatively substituted for the corresponding components in FIGS. 2–4, as the engine reciprocates the pump piston 28, a rod reciprocates within axial bore 140', and intake or formation fluid is available at 44 and 45, while produced fluid is exhausted from the pump at 42. The piston upstrokes and downstrokes while the opposed biased valve elements alternately are forced against the corresponding upstanding seats so that fluid is forced to flow into and out of the working chamber in response to reciprocation of the pump piston.

The combination of the improved valve structure of the present invention can be used in hydraulically actuated pumps of a reciprocatory nature having a connecting rod which is connected to another piston located further below the valve assembly 32; or alternatively, the rod may be a stinger which extends down through bushing 63, so that fluid pressure is available at the end thereof for providing an upward thrust in accordance with some of the recited previous patents.

The valve structure of the present invention forms a closure member at the lower end of the pump barrel to form a working chamber, with the rod being brought axially through the valve structure, while fluid flows into the working chamber by means of the spaced intake ports at 58. The fluid flows out of the working chamber by means of the spaced passageways 48 formed in the valve structure. The valve structure includes opposed faces 66 and 68, with the before mentioned passagewys being parallel to the axial bore 40', and a standoff valve seat 59 being affixed to the outer end of each of the passageways. A closure means, in the form of elements 56 and 60, concurrently closes against each valve seat. The intake ports include a blind counterbore 73 extending part of the way through the valve structure into proximity of, but spaced from, said lower face 68.

The valve plate is fixed relative to the pump barrel, while the valve elements 56 and 60 are captured within the longitudinal grooves of the barrel, thereby preventing axial rotation of the valve elements while permitting longitudinal movement thereof. Consequently, the valve elements may be fabricated so that the marginal area of the face 88 located between the corners 76 and the aperture 82 is biased into sealed engagement with the valve seat 57 or 59.

As another embodiment of the present invention, the valve seats can be located on the valve element as taught in conjunction with FIG. 9, for control of fluid flow through passageways 147 and 148.

While only four valve seats are shown on each opposed side of the valve plate of FIGS. 2–8 and on the valve element of FIG. 9, it should be understood that the configuration of the valve plate and valve element can be changed to accommodate other numbers of passageways 47 and 48 if deemed desirable to do so.

A valve assembly in combination with a pump made in accordance with the present invention provides the unexpected result of reduction in wear due to impingement and excessive turbulence as fluid flows through the various ports. Hence, the configuration of the present valve device reduces the effect of abrasive particles which may be entrained within the formation fluid as it flows through the valve assembly. The improved flow path presented by the present invention provides a valve assembly which exhibits a longer life, as well as improved operating characteristics.

I claim:

1. In a hydraulically actuated, downhole pump assembly having an engine which reciprocatingly drives a production pump piston within a pump barrel, with the pump piston being connected to the engine by a connecting rod, the combination with said pump piston and rod of a valve device which controls the flow of production fluid into and out of the pump barrel;

said valve device includes a valve plate having the form of a circular hub, said plate includes opposed upper and lower faces which are spaced apart by a sidewall; and axial bore extending through said plate for sealingly receiving the rod therethrough in a reciprocating manner, and a plurality of circumferentially spaced passageways extending through said plate such that the axial centerline thereof is parallel to and radially spaced from the axial centerline of said axial bore;

means forming an exhaust valve seat on said lower face at the end of each said passageway; a closure means for each said seat;

means forming a plurality of circumferentially spaced intake ports through said valve plate, each port includes a counterbore which is spaced from said radially spaced passageways and extend from said upper face and only partially through said plate and then radially outward through said sidewall, with there being one of said ports located between adjacent passageways;

means forming an intake valve seat at the end of each said port, a closure means for each said intake valve seat; means resiliently biasing each of said closure means into abutting engagement with the nearest adjacent seats;

each closure means being a valve element which is square in configuration, means forming an axial passageway through said element through which the rod is reciprocatingly received;

means, including sidewalls, forming an intake chamber on one side of the valve plate and an exhaust chamber on the opposed side of the valve plate;

groove means formed in the sidewall of the chamber, said groove means are longitudinally disposed in spaced relation to the rod;

the corner of the valve element are slidably received within the groove means for preventing axial rotation of the valve element, so that the area of the valve element which is between the corner and the axial passageway is always oriented in a position to be biased into seated relationship respective to the nearest seat; and, the sides of the valve element located between adjacent corners cooperate with the sides of the nearest chamber to form a crescent shaped flow port through which fluid flows across the valve element.

2. The valve device of claim 1 wherein there are four passageways and four ports, means by which the valve element located adjacent to the lower face simultaneously sealingly engages the seats formed at the end of said four passageways;

and means by which the valve element located adjacent to the upper face simultaneously sealingly engages the seats formed at the end of said four ports.

3. In a production pump assembly of the reciprocating type, wherein the pump assembly includes a barrel within which a piston is reciprocated by a connecting rod, and a valve structure forms a closure member at one end of the barrel to form a working chamber; while fluid flows into said working chamber by means of intake ports formed within said valve structure, and out of said working chamber by means of sapced outlet passageways formed in said valve structure; the improvement comprising:

said valve structure includes a valve plate having opposed faces and a circumferentially extending sidewall between said opposed faces, said passageways being circumferentially spaced apart and formed throgh said valve plate and having a marginal end which is parallel respective to the longitudinal axial centerline of said barrel; a closure means for concurrently closing against each end of said passageway to permit flow in one direction respective to flow into and out of the working chamber;

said intake ports being circumferentially spaced apart and formed in said valve plate with there being one said intake port located between adjacent ones of said passageways; another closure means for concurrently closing against each inlet port to permit fluid to flow into said working chamber;

means forming an intake chamber on one side of the valve plate and an exhaust chamber on the opposed side of the valve plate; means forming a groove in the sidewall of the exhaust and intake chambers, said grooves are longitudinally disposed in spaced relation respective to said axial centerline;

each closure means being a valve element which is a polygon in geometrical configuration; there being an intake valve element and an exhaust valve element;

the corners of the intake and exhaust valve elements, respectively, being slidably received within said grooves of said intake and exhaust chambers, respectively, for preventing axial rotation of the valve elements; and, means by which the area of the intake and exhaust valve elements, respectively, which is located between said corner and the axial centerline of the valve elements is baised into sealed relationship respective to the end of the port and passageway, respectively, of the valve plate; and, the edges of the valve elements which extend between the corners are spaced from the chamber walls and form a flow passageway therebetween.

4. The improvement of claim 3 wherein the sides of the valve element located between adjacent corners cooperate with the sides of the chambers to form a crescent shaped flow port through which fluid flows across the valve element;

said valve element is square in configuration, thereby presenting four said crescent shaped flow passageways;

and, valve seats are formed on said valve element for sealingly engaging said valve element at the end of said flow port and said flow passageway.

5. The improvement of claim 3 wherein there are four passageways and four intake ports, means forming an upstanding valve seat at the end of each passageway and the end of each port; each valve element is urged into sealed engagement respective to each said seat of said adjacent valve element.

6. The improvement of claim 3 wherein said valve element is square in configuration, thereby preventing four said crescent shaped flow passageways.

7. The improvement of claim 6 wherein said valve plate and said valve elements are centrally apertured to accommodate a piston rod which is reciprocatingly received along said longitudinal central axis.

* * * * *

UNITED STATES PATENT AND TRADEMARK OFFICE

CERTIFICATE OF CORRECTION

PATENT NO. : 4,369,022
DATED : January 18, 1983
INVENTOR(S) : George K. Roeder

It is certified that error appears in the above—identified patent and that said Letters Patent is hereby corrected as shown below:

Column 1, line 44, substitute --Furthermore-- for "Further";
Column 2, line 40, substitute --produced-- for "production";
Column 3, line 53, insert --as-- before "may";
Column 5, line 46, substitute --There-- for "These";
Column 6, line 18, correct the spelling of "passageways";
Column 7, Claim 3, line 59, correct the spelling of "spaced";
Column 8, line 2, correct the spelling of "through";
Claim 5, line 56, substitute --an-- for "said";
Claim 6, line 58, substitute --presenting-- for "preventing".

Signed and Sealed this

*Twenty-fourth* Day of *May 1983*

[SEAL]

*Attest:*

DONALD J. QUIGG

*Attesting Officer* *Acting Commissioner of Patents and Trademarks*